US007905435B1

(12) United States Patent
Scepaniak

(10) Patent No.: US 7,905,435 B1
(45) Date of Patent: Mar. 15, 2011

(54) ROOF GRINDER

(76) Inventor: Kurt Scepaniak, Cold Spring, MN (US)

( * ) Notice: Subject to any disclaimer, the term of this patent is extended or adjusted under 35 U.S.C. 154(b) by 907 days.

(21) Appl. No.: 11/615,675

(22) Filed: Dec. 22, 2006

Related U.S. Application Data

(60) Provisional application No. 60/753,472, filed on Dec. 22, 2005.

(51) Int. Cl.
*B02C 23/20* (2006.01)

(52) U.S. Cl. ..... 241/60; 241/242

(58) Field of Classification Search ..... 241/60, 241/243, 242
See application file for complete search history.

(56) References Cited

U.S. PATENT DOCUMENTS

| | | | | |
|---|---|---|---|---|
| 2,853,742 | A | 9/1958 | Dasher | |
| 3,190,565 | A | 6/1965 | Jayna, Jr. | |
| 3,633,830 | A | 1/1972 | Oberpriller | |
| 3,658,267 | A | 4/1972 | Burwell | |
| 3,850,364 | A | 11/1974 | Robbins | |
| 4,098,463 | A * | 7/1978 | Lowry | 241/17 |
| 4,411,390 | A * | 10/1983 | Woten | 241/98 |
| 4,465,239 | A * | 8/1984 | Woten | 241/98 |
| 4,978,252 | A * | 12/1990 | Sperber | 406/64 |
| 5,115,983 | A | 5/1992 | Rutherford, Sr. | |
| 5,201,472 | A | 4/1993 | Brock | |
| 5,337,965 | A | 8/1994 | Chiovitti | |
| 5,385,426 | A | 1/1995 | Omann | |
| 5,386,947 | A | 2/1995 | Omann | |
| 5,451,003 | A | 9/1995 | Omann | |
| 5,454,521 | A | 10/1995 | Frazier et al. | |
| 5,533,680 | A | 7/1996 | Lagrone | |
| 5,782,417 | A | 7/1998 | Niederholtmeyer | |
| 5,829,649 | A * | 11/1998 | Horton | 222/636 |
| 5,904,305 | A | 5/1999 | Kaczmarek | |
| 5,927,627 | A | 7/1999 | Edson et al. | |
| 6,086,002 | A | 7/2000 | Frazier et al. | |
| 6,109,488 | A * | 8/2000 | Horton | 222/636 |
| 6,969,017 | B2 * | 11/2005 | Irwin | 241/60 |

* cited by examiner

*Primary Examiner* — Faye Francis
(74) *Attorney, Agent, or Firm* — Albert W. Watkins

(57) ABSTRACT

A roof grinder is operative to both comminute and transport rubber, asphalt, insulation, rock and other diverse material. The grinder has a cutter which comminutes commercial roofing material. An air transport uses a high velocity air stream to blow the comminuted particles to a collection site on the ground. A rotary air lock couples to the cutter for receiving comminuted roofing material and isolates the cutter from the air transport, to prevent high velocity air from passing through the rotary air lock to cutter. The device is sized for placement on the roof, and has wheels or tracks for easy movement. A flexible hose couples the air transport to a remote location for discharge, such as to a roll-off container. In an alternative embodiment, a roof grinder is operative to both comminute and transport rubber, asphalt, insulation and rock material, and the cutter is operative upon a roof sub-floor to both remove and comminute commercial roofing material.

11 Claims, 5 Drawing Sheets

ROOF GRINDER

CROSS REFERENCE TO RELATED APPLICATIONS

This application claims priority to United States provisional patent application Ser. No. 60/753,472 filed Dec. 22, 2005 of like title and naming the present inventor, the contents which are incorporated herein by reference in entirety.

BACKGROUND OF THE INVENTION

1. Field of the Invention

This invention pertains generally to the field of solid waste disposal, and in a most preferred embodiment to commercial roof removal and disposal.

2. Description of the Related Art

One of the most basic necessities of mankind has long been known to be that of shelter. A common phrase which describes this need is simply that of "a roof over your head." The primary purpose of this roof is to keep the elements from entering from above and adversely affecting the contents and occupants of a building. First and foremost among the elements to be kept out is moisture.

Many early roofs were simply leaves, thatch, or the like. Such roofs were not resistant against high winds, and would invariably, frequently and unpredictably leak. With proper slope and enough plant matter, it is certainly possible to construct a roof that does not leak. However, most plant matter is not amenable to being securely anchored in a way which will reliably keep water out during high winds and storms. Furthermore, plant matter decays at a relatively high rate, making it difficult to construct a roof with a reasonably long life expectancy. In addition, plant matter is prone to infestation by insects and animals, which in turn greatly accelerate damage and the rate of failure.

Throughout the ages, there have been many advances in nearly every part of living, and nearly all of these are dependent in some degree or another upon that same basic necessity that we generally describe as shelter. In the modern era in which we live, there are few possessions of people that can withstand exposure to moisture. This is particularly true with modern conveniences, such as electrical lighting, computers, appliances and the like. Many interior building materials are equally as susceptible to damage by moisture. In fact, long term or frequent exposure to moisture can literally destroy an entire building, even if individual possessions remain protected therein.

As may be apparent, roofs are vital for a number of reasons, and form one critical basis of our modern society. As may be appreciated then, there has been an enormous amount of technology and time applied to the development of suitable roofing for each of the many applications that civilization demands. Asphalt shingles are common in residential roofs, where the roof will slope at a significant angle. The benefit of this slope is an improved shedding of water, snow, and ice, ensuring that as long as the shingles are overlapping in a fish-scale fashion the water, snow, or ice will not travel backwards against the force of gravity. In turn then, as long as the shingles do overlap properly, no water will reach the roof underlayment and so the building will stay dry. When a problem arises, such as the loss of a shingle, it is often readily visible. Appropriate measures may then be taken to replace either one or a few shingles. If instead the failure was caused by aged shingles that have become brittle or are otherwise no longer serviceable, then the shingles are torn off and replaced in entirety. While asphalt shingles are most common, other shingle materials in use include fiberglass, cedar, slate, metals such as steel and copper, and even clay.

This has worked well for the relatively smaller sizes of individual residential roofs. While the slope adds somewhat to the overall cost of the building, additional sheltered space or even upper level rooms are commonly located in the attic directly below the roof, thereby benefitting the home occupants with extra useful space. When an excessive quantity of snow falls onto the roof, a homeowner may simply scrape the snow from the roof using a roof rake or the like. In some instances, where a great enough slope exists, the snow will slide off by itself, or when the weather warms, the snow will melt or slide off.

In contrast to a residence, many commercial buildings are much larger, having many times the square footage to be covered. Moreover, with a commercial building, the building owner is not responsible just for the safety of the owner, but also for the safety of many other individuals as well. Features that are acceptable in individual residences are no longer acceptable in commercial buildings. Moreover, owing to the size differential, features that would be harmless in residential applications can prove to be downright dangerous and life threatening in a larger commercial building. Consider for example the case of a simple icicle, which is commonly seen in the moderate and northern latitudes during the colder months. An icicle which breaks and falls from an eight-to-ten foot height presents little hazard to a person walking thereunder. A small clunk is all that may be reasonably expected. However, if the icicle is falling from a ten story or higher commercial building, the icicle could be truly hazardous. The same is true of wet and heavy snow or packed icy snow that may at times accumulate on a roof. Using the standard residential construction, a person might be buried or even killed by large quantities of snow and ice sliding from a large commercial roof. As a result, few commercial roofs are sloped like a residential roof. When they are sloped, they will most commonly be sloped at great degree such that there will be no chance of accumulation. Even in these situations, the high volumes of water that will be shed from a large roof onto the perimeter of the building, even in relatively gentle rains, might be likened to walking into a waterfall. If for this reason if no other, a sloped roof over a large building is usually highly undesirable and unpleasant. Consequently, most frequently a commercial roof is designed in a completely different way from a residential roof. First, the roof is most typically relatively flat, with only a minor slope. The slope will most commonly lead to a drain that might lead in many cases directly to a storm sewer or the like, such that any run-off from the roof is directed through pipes directly to a municipal storm system or other suitable drain. This generally flat surface normally terminates at a level below the building sides, often times several feet below. When precipitation falls upon the roof, it will either be directed through gentle slope into the drain, or if in the form of snow or ice, it will simply accumulate on the top of the roof until warmer weather arrives.

Since the commercial roof necessarily does not have the benefit of slope found in a residential roof, the materials used in the fabrication thereof differ in several very significant ways. Most consequentially, the commercial roof must behave like a swimming pool liner, and serve as a total water barrier for standing water which might accumulate thereon. The roof must also be quite robust, and be able to withstand the weight of many pounds per square inch of accumulated water, snow or ice. There will be very wide temperature extremes, not only with the extreme cold but also with summer sun and heat, and little direct air movement owing to the building walls forming a ledge. Finally, the commercial roof will be exposed to periods where water is contained therein, and other periods where the roof is simply dry and parched like a desert.

Ordinary residential shingles are designed simply to shed water, passing the water down to the next shingle, until there are no more shingles and the water falls from the roof. In contrast, a commercial roof must contain the water through all extremes. As a result, commercial roofs are much more complex than simple residential shingles. Common commercial roofing materials will generally include some combination of insulation layers, tar, rubber or elastomeric water barriers, and smaller rocks or pebbles. Common types of low sloped roofing for industrial/commercial structures include the built-up-roof (BUR), modified bitumen, Sprayed-in-Place Polyurethane Foam (SPUF), and/or membrane layers which often consist of plies of polymers or elastomers, such as EPDM, CSPE, PVC, and TPO.

The built-up-roof (BUR) comprises multiple plies of asphalt saturated organic felt or coated fiberglass felts. The individual plies of felt are adhered with hot asphalt, coal tar pitch or adhesive. The modified bitumen roof is heat welded, asphalt adhered or installed with adhesive. In this roof, asphalt is mixed with polymers such as Atactic Polypropylene (APP) or Styrene Butadiene Styrene (SBS), then applied to fiberglass and/or polyester mat, and seams are sealed by locally melting the asphalt with heat, hot mopping of asphalt, or adhesive. Sprayed-in-Place Polyurethane Foam (SPUF) is simply foam sprayed in-place on the roof, and then coated with a wide variety of coatings, or in some instances, covered with gravel.

Since the introduction of elastomeric and polymer flexible-sheet membranes some thirty years ago, membrane roofing materials now comprise more than half of the commercial roofing market. There are a wide variety of membrane materials, including both thermosetting plastics and rubbers and thermoplastic materials. EPDM (ethylene propylene diene monomer) rubber membranes; PVC (polyvinyl chloride); TPO (ThermoPlastic Olefin); and CSPE (chlorosulfonated polyethylene) synthetic rubber are all commonly used. As but one example of the complexity of these modern materials, TPO is a trade name that refers to polymer/filler blends usually consisting of some fraction of polypropylene, polyethylene, block copolymer polypropylene, rubber, and a reinforcing filler. Common fillers in this TPO blend include talc, fiberglass, carbon fiber, wollastonite, and Metal Oxy Sulfate. Common rubbers in a TPO blend include ethylene-propylene rubber, EPDM, ethylene-octene, ethylene-butadiene, and styrene-ethylene-butadiene-styrene. There are an ever-increasing variety of commercially available rubber and block copolymer polypropylene material available which are incorporated into TPO.

These materials are used to cover large areas of buildings. Unfortunately, when the materials fail, such as might be due to unavoidable aging, leaks or precursor cracks may develop that require repair or replacement. As already noted, these roofs are often quite large, covering a great many square feet. Furthermore, the roofing material is usually quite heavy, making the task of removing the old material from the roof quite daunting. Finally, there are a very wide variety of materials used in the fabrication of these roofs, as noted above.

In the prior art, the task of commercial roof removal has been accomplished by cutting smaller sections of the material off, stacking it into wheel barrows and the like, and manually hauling it to be loaded into some type of waste container. For shorter buildings, the wheelbarrow might simply be dumped over the edge of the roof into a waiting roll-off container or the like. With taller buildings, it may be necessary to set up some type of boom, crane or other structure to lower containers of the waste material from the roof. In either case, the manual labor is intensive, and the risk of work-related injury undesirably great.

Regardless of the method of removal, the roofing material is next disposed of as ordinary waste in a landfill or the like, using up valuable land resource and not recovering any value from the materials being disposed of. Furthermore, the waste containers themselves are only partially filled, owing to the irregular stacking that inevitably occurs from the slabs and small rolls of the material being dropped irregularly into the container. Consequently, the waste dumping fees are undesirably higher due to the state of the material.

To overcome the limitations of the manual methods of removal and disposal of roofing materials, several shingle grinders have been devised, as illustrated in a number of U.S. Pat. Nos. including 5,201,472 to Brock; 5,385,426, 5,386,947 and 5,451,003 to Omann, the contents and teachings of each which are incorporated herein by reference. Each of these patents illustrate the use of hammer mills, which are effective with more brittle materials, but relatively ineffective when applied to elastomers and the like. Consequently, while the methods proposed therein may have much utility for the grinding of residential asphalt shingles, little teaching is provided for handling the far more diverse materials, including elastomers and polymers as well as asphalt and rock found in commercial roofing. Furthermore, these patents do little to provide a reasonable approach for removing material from a large commercial roof.

Another patent of interest, which introduces the concept of a grinder in combination with a blower is U.S. Pat. No. 3,658,267 to Burwell, entitled "Apparatus for Disintegrating Tires and the Like." This patent, the teachings which are incorporated herein by reference, illustrates a tire grinding apparatus that reduces the tires down to a powdered form prior to sucking the dust out through a vacuum. Once again, the method used to reduce the rubber is of little applicability to commercial roofing material, since it would almost immediately clog from the asphalt and similar content. Furthermore, the teaching of transporting rubber dust provides little benefit to the roofing industry, where again asphalt and other components will tend to agglomerate any dust.

U.S. Pat. Nos. 3,850,364 to Robbins and 6,086,002 and 5,454,521 to Frazier et al, the teachings of each which are incorporated herein by reference, disclose a grinder in combination with a fan to drive comminuted material to and through a discharge chute. However, these patents are for lawn debris and plant matter instead of rubber and asphalt, and so like Burwell treat material with very different characteristic than the rubber, asphalt and rock combination of commercial roofing.

Other patents pertaining methods for comminuting rubber, for which the teachings are incorporated herein by reference include U.S. Pat. Nos. 2,853,742 to Dasher; 3,190,565 to Jayne, Jr.; 5,115,983 to Rutherford, Sr.; 5,782,417 to Niederholtmeyer; 5,904,305 to Kaczmarek; and 5,927,627 to Edson et al. As with the other references already described, these methods and apparatus are not applicable to the complex roofing material used in commercial roofs, which typically includes some combination of rubbers and polymers, asphalt and rock.

There are several methods which are, in fact applicable to the complex roofing materials found on commercial roofs. The include cryogenic cooling of the materials prior to grinding, such as for exemplary purposes illustrated in U.S. Pat. Nos. 3,633,830 by Oberpriller and 5,533,680 by LaGrone, the teachings which are incorporated herein by reference. U.S.

Pat. No. 5,337,965 by Chiovitti illustrates another approach, the teachings which are incorporated herein by reference, that of solvent immersion. As may be readily understood, both cryogenic cooling and solvent immersion are undesirably expensive, complex, and less safe than a direct grinding process. The solvent system also introduces a new waste issue, with regard to the proper separation and handling of the solvent. Consequently, while operative, neither the cryogenic or solvent systems are suitable for large scale application to the removal of commercial roofing materials.

SUMMARY OF THE INVENTION

In a first manifestation, the invention is a roof grinder operative to both comminute and transport rubber, asphalt, insulation and rock material during building renovation which saves manual labor and provides for compact waste disposal. The roof grinder comprises a cutter which comminutes commercial roofing material. An air transport has a high velocity air stream which receives comminuted roofing material and transports the material within the high velocity air stream. A rotary air lock couples to the cutter for receiving comminuted roofing material and couples to the air transport to deliver received comminuted roofing material thereto while preventing the high velocity air stream from passing through the rotary air lock to cutter.

In a second manifestation, the invention is a roof grinder operative to both comminute and transport rubber, asphalt, insulation and rock material during building renovation which saves manual labor and provides for compact waste disposal. The roof grinder comprises a cutter which comminutes commercial roofing material. An air transport has a high velocity air stream which receives comminuted roofing material and transports the material within the high velocity air stream. A mobile frame supports the cutter and air transport. A flexible hose couples to the air transport for receiving the high velocity air stream with entrained comminuted roofing material, and transports the high velocity air stream with entrained comminuted roofing material to a remote location for discharge.

In a third manifestation, the invention is a roof grinder operative to both comminute and transport rubber, asphalt, insulation and rock material during building renovation which saves manual labor and provides for compact waste disposal. The roof grinder comprises a cutter which comminutes commercial roofing material. The cutter comprises a first rotating drum carrying a plurality of teeth protruding therefrom. The cutter also comprises a second fixed blade having a non-linear cutting edge with a first cutting surface between at least two of the plurality of teeth and a second cutting surface more distal from the rotating drum than the at least two of the plurality of teeth. An air transport has a high velocity air stream receiving comminuted roofing material and transports comminuted roofing material within the high velocity air stream.

OBJECTS OF THE INVENTION

Exemplary embodiments of the present invention solve inadequacies of the prior art by providing an in-feed conveyor to control the introduction of material into a uniquely designed cutter. The cutter breaks the roofing material into relatively small chunks, which are then passed into an air lock. From the air lock, the comminuted roofing material is introduced into an air stream for transport through a conduit such as a hose or the like, to be carried preferably off of the roof and down to a ground-level bin or container.

A first object of the invention is to provide an apparatus capable of breaking down commercial roofing material into small chunks using mechanical means and without immersion. A second object of the invention is to transport these chunks through a convenient flexible hose or other suitable conduit to a receptacle. Another object of the present invention is to enable commercial quantities of this roofing material to be processed directly from the rooftop. A further object of the invention is to enable compact storage of the waste roofing material in a waste receptacle, with minimal air space. Yet another object of the present invention is to provide a mobile system which may be maintained very close to a work area at all times, eliminating the need to manually transport waste commercial roofing material across large distances.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides, in combination, a grinder and blower operative to both comminute and transport rubber, asphalt, insulation, rock and other material during building renovation. The present invention is most applicable to commercial roofing. However, upon a reading of the present disclosure and with an understanding of the complexities of the composition of such roofing, it will be understood that the teachings provided herein may be applied to other materials as well, where the present invention will also provide benefit.

As has been already discussed herein above, prior art commercial roofing material is typically comprised by some combination of rubber, asphalt, fine aggregate, insulation and fibrous materials. After serving out a useful life measured in years, the roofing material will accumulate additional dust and dirt. Through the seasons, the roofing material is exposed to extreme heat and cold, which causes the material to alternately expand and contract. As the material ages, it may no longer adequately stretch and contract, and so must be replaced.

Replacement requires removing the roofing material from the building, which in the prior art has meant tearing the roofing material off, and subsequently carrying the material to some type of container. The container may be an intermediate container, which is subsequently emptied into a larger roll-off container, or the roofing may be directly deposited into the roll-off. Unfortunately, the roofing material is inherently flake-shaped, and so does not drop perfectly into the container. In some cases, the roofing flakes may drift off target and not land in the container, if dropped from above. In nearly all cases, the flakes will not stack well and so will require substantial additional volume for disposal. Finally, the manual labor and time necessary for carrying the roofing about is detrimental to the primary task of removing the roofing.

Figure 1:
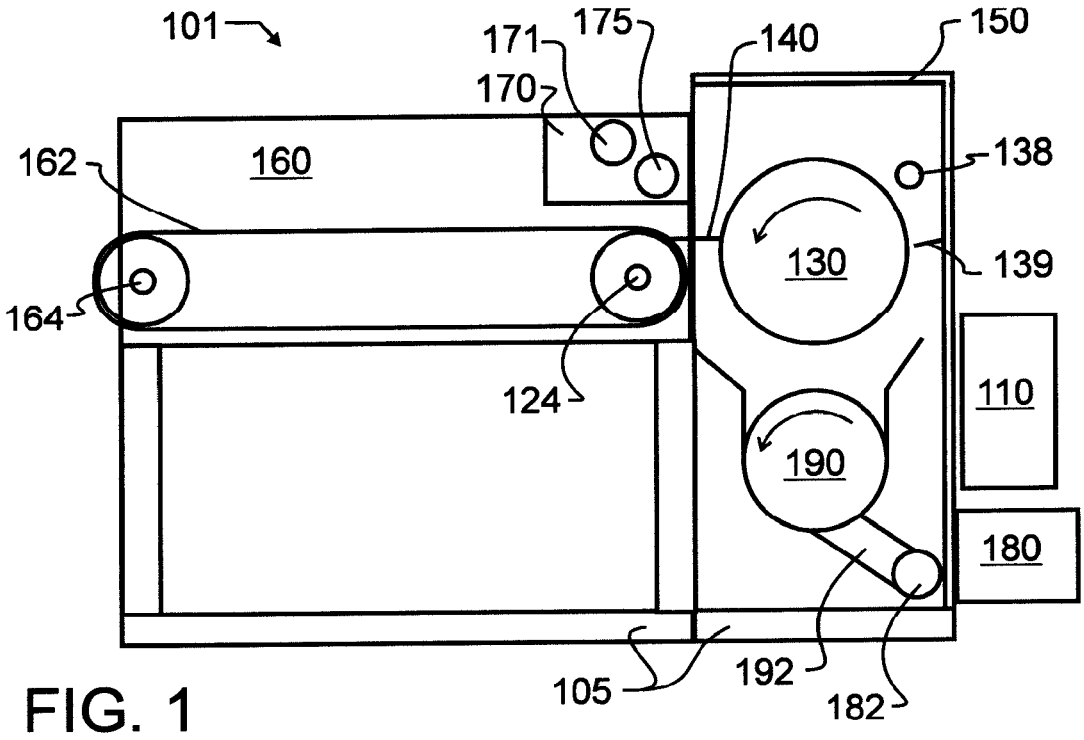
FIG. 1 illustrates a first preferred embodiment roof grinder designed in accord with the teachings of the present invention from a side schematic view.

A first preferred embodiment roofing grinder 101 is illustrated in FIG. 1, by a simplified schematic diagram. The most critical components include cutter wheel 130 which effects the grinding of material, engine 110 which provides motive power, and a base 105 upon which the remaining components are supported. Cutter 130 will desirably be driven in a rotary motion from engine 110 motive power coupled through any appropriate coupling including but not limited to drive belt, chain, hydraulic drive, or other suitable technique. A corresponding fixed blade 140 is provided extending radially from cutter 130, and provides an opposed edge, as will be described in more detail herein below. Cutter 130 will most preferably be operative under a protective shroud, hood or similar enclosure 150, to capture any debris that might become airborne during grinding. A misting or spray nozzle 138 is preferably provided on a back side of cutter 130, such that as a surface of cutter 130 approaches material to be comminuted, a light spray of water or other suitable material may be applied thereto. The spray will simultaneously cool the cutters, assist with dust control, may dislodge small particles or residue on cutter 130, and will also form a slight barrier to the adhesion of asphalt and rubber to the cutter, owing to the repulsive nature of water to oil. The need for such a spray, the specific material being sprayed, whether gaseous or liquid, and the volume being sprayed are all factors that will be determined by those reasonably skilled in the art at the time of design or production of the preferred roof grinder 101.

In order to safely move roofing material into a position to be comminuted, a material conveyor 160 is provided which has a moving belt 162 and a tensioning adjustment 164. A driving roller 124 is also provided to drive belt 162 adjacent to cutter 130, and in the preferred embodiment will be coupled to engine 110 through drive belt, chain, hydraulic drive, or other suitable technique. Infeed roller 170 is a compound drive incorporating two individual rollers 171, 173 which cooperate with moving belt 162 to force material into contact with cutter 130. Most preferably, infeed roller 170 will be able to float relative to material conveyor 160 so that varying thickness of material being transported upon moving belt 162 may be accommodated. This is important since the thickness of material being comminuted may not be predictable, and may vary even at different locations upon the same roof. Where infeed roller 10 does not intrinsically have sufficient weight, cover 150 may provide a source of force down on infeed roller 170, or additional or separate weights or springs may be provided.

Figure 7:
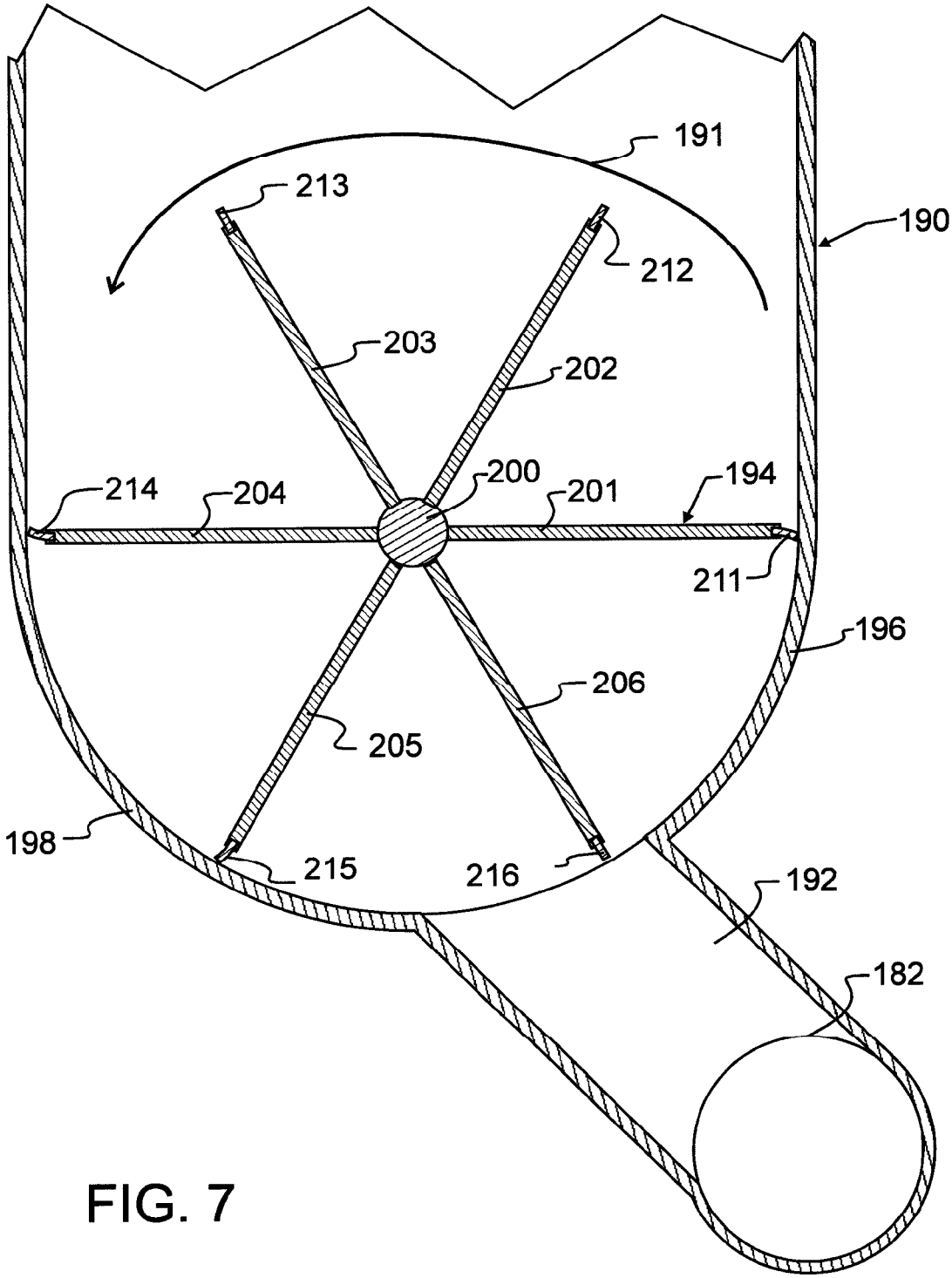
FIG. 7 illustrates a rotary air lock operative with the preferred embodiment roof grinders of FIGS. 1 and 2.

Once the roofing material has been comminuted, the material is next collected in air lock 190 and then discharged therefrom through a collector 192. Air lock 190, which is described in greater detail herein below with respect to FIG. 7, provides isolation between an elevated pressure airstream created by blower 180 and the atmospheric pressure in shroud 150 in the vicinity of moving belt 162 and cutter 130. This prevents air from blowing comminuted material back towards material conveyor 160, and instead ensures that the material is swept out through outlet 182.

Figure 2:
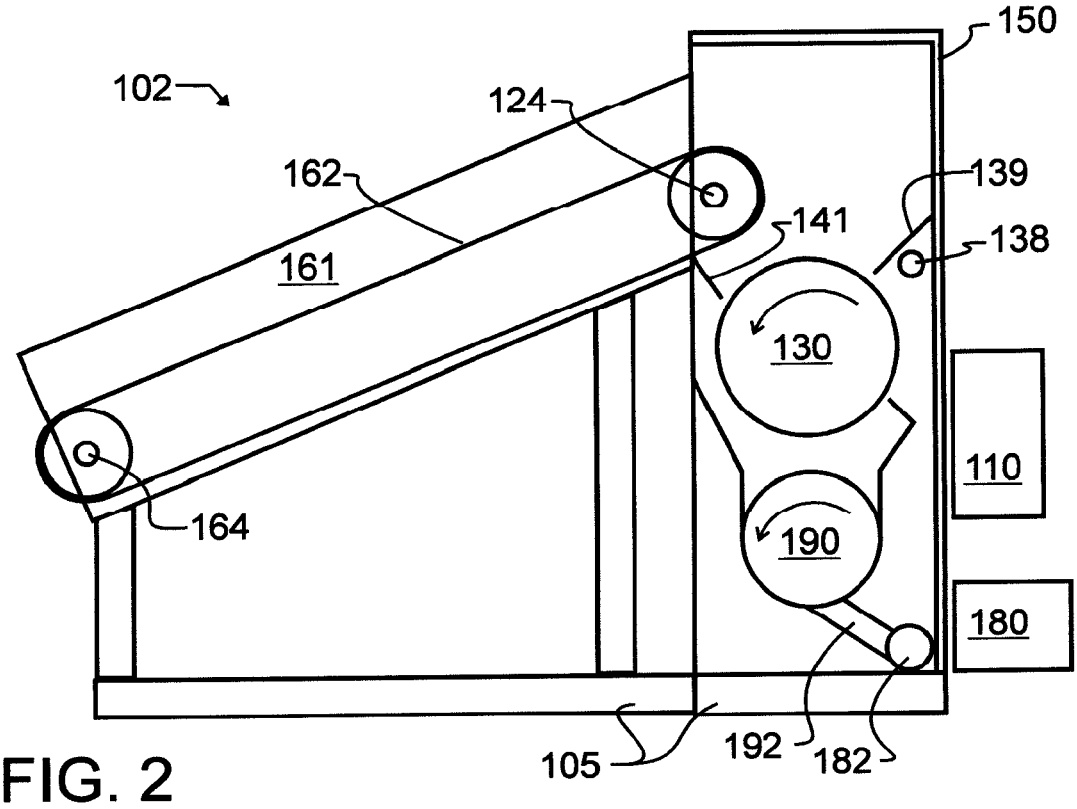
FIG. 2 illustrates a second preferred embodiment roof grinder designed in accord with the teachings of the present invention from a side schematic view.

FIG. 2 illustrates a second preferred embodiment roof grinder 102 designed in accord with the teachings of the present invention. Where like numerals are used as those in the first preferred embodiment roof grinder of FIG. 1, the parts will be understood to performing substantially the same function in substantially the same way as that shown in FIG. 1. However, there are a few important differences between roof grinder 102 and roof grinder 101. One of these is the orientation of material conveyor 161 compared to that of material conveyor 160. It will be apparent from FIG. 2 that material conveyor 161 is oriented at an incline. Material is lifted from an elevation which may be the same or even lower than that of material conveyor 160 adjacent to tensioning adjustment 164. The discharge end adjacent cutter 130 is at a much higher elevation. In this second embodiment, gravity is relied upon to drive roofing or other material into contact with cutter 130. Consequently, there is no need for infeed roller 170. Fixed blade 140 was relatively horizontal, in accord with the generally horizontal introduction of material from material conveyor 160. In this second embodiment roof grinder 102, fixed blade 140 is replaced by fixed blade 141, which is simply fixed blade 140 moved to a new non-horizontal position. In fact, with the vertical material infeed, fixed blade 141 may be positioned in any position through an arc about cutter 130, so long as the material is dropped into contact with cutter 130 prior to that portion of cutter 130 engaging with fixed blade 141. In FIG. 2, this permits a variance in angular position for fixed blade 141 that would encompass a nearly ninety degree range of acceptable positions.

Also visible in FIG. 2 is an optional material shield 139, which could be applied in either roof grinder 101 or 102. The material shield is simply limiting material which might otherwise fall on the wrong side of cutter 130 and consequently avoid being carried by cutter 130 into contact with fixed blade 140, 141.

Figure 3:
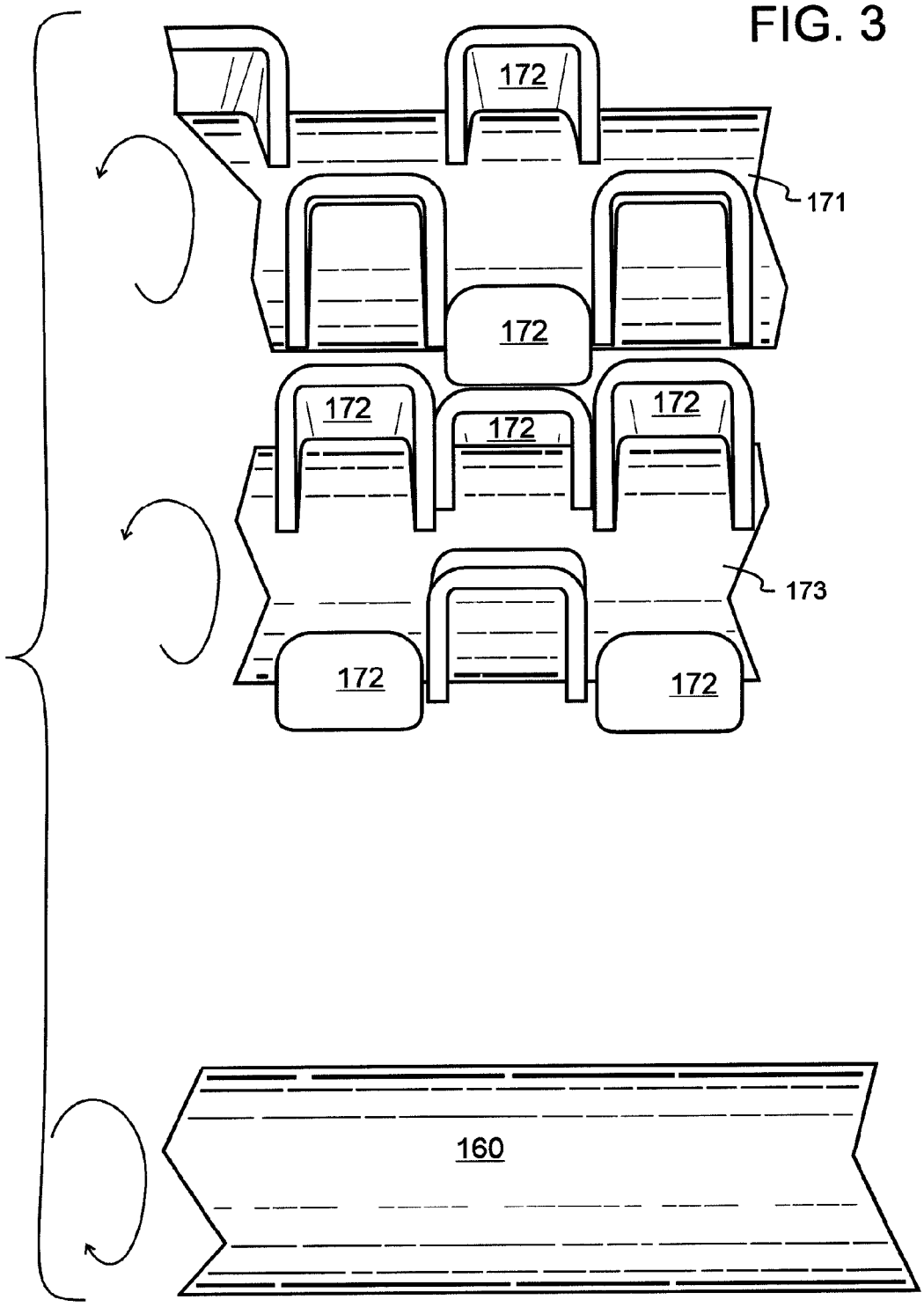
FIG. 3 illustrates a preferred in-feed roller apparatus which is designed to operate as a component of the first preferred embodiment roof grinder of FIG. 1, from an enlarged sectional end view.

FIG. 3 illustrates by enlarged partial view individual rollers 171, 173, which assist with the feed of roofing into cutting wheel 130. This view represents looking from adjacent cutter 130 towards tensioning adjustment 164. Individual rollers 171, 173 are generally cylindrical and carry on their perimeter a large number of specially shaped teeth 172. Teeth 172 are so shaped to be operative with a large number of materials. The waterwheel bucket geometry helps to ensure that these teeth 172 neither bend nor slip on material being comminuted by cutter 130. As may be seen in FIGS. 1 and 3, individual roller 171 is higher off of moving belt 162 than individual roller 173, and also farther from cutter 130. By rotating as shown in FIG. 3, which would be counterclockwise in the view of FIG. 1, individual roller 171 will draw material in the same direction as moving belt 162, and will drive the material towards individual roller 173. Individual roller 173 will similarly act on the material, trapping it between individual roller 173 and moving belt 162. Since both individual roller 173 and moving belt 162 are urging the material towards cutter 130, the material has little opportunity for movement other than into cutter 130.

Figure 4:
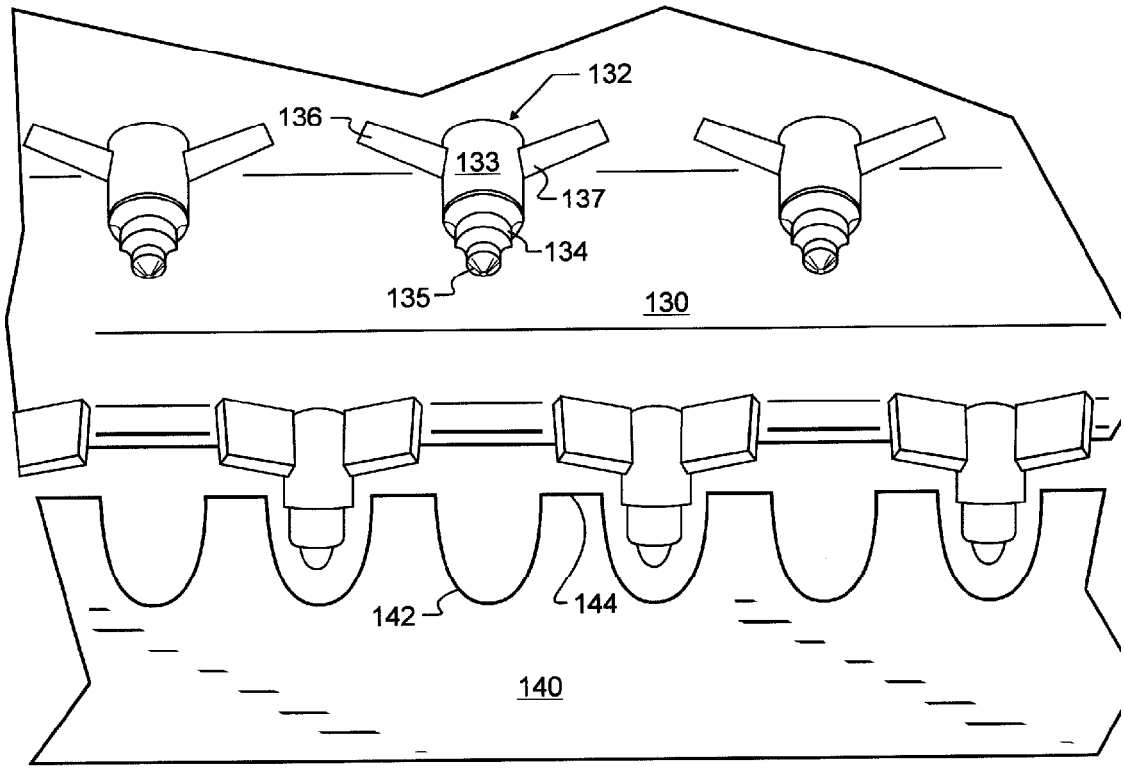
FIG. 4 illustrates a preferred set of grinding teeth rotating on an armature and interacting with a stationary cutter or grinding plate, operative in association with both preferred embodiment roof grinders of FIGS. 1 and 2, by enlarged sectional view.

FIG. 4 illustrates cutter 130 from an enlarged view. Similar to individual rollers 171, 173, cutter 130 is also generally cylindrical, and carries cutter teeth 132 about the perimeter surface. Each cutter tooth 132 includes a hardened carbide 134 having a slightly rounded tip 135. These carbides are preferably designed to spin within and be retained by holder 133. Finally, a pair of deflected back wings 136, 137 are provided. Fixed blade 140 is provided, and material to be comminuted will pass into engagement between teeth 132 and fixed blade 140. As each cutter tooth 132 passes fixed blade 140, the cutter tooth will pass through an opening 142 therein, shearing the roofing material and forcing it through. Subsequent to carbide 134 passing through, wings 136, 137 will pass adjacent to cutting edge 144. Since the wings are swept back, they are highly unlikely to jamb, and have been demonstrated to crush the gravel commonly found in roofing materials, while shearing the remaining materials. This novel geometry ensures that material is comminuted without folding over, as is commonplace where cutter and fixed blade form a single cutting line.

Most desirably, cutting teeth 123 do not extend parallel to a radial line, but instead are slightly offset therefrom. Desirably, and as described above, tip 135 will contact the material first, and then subsequent thereto holder 133 will pass through opening 142. Finally, wings 136, 137 will engage with any material adjacent to cutting edge 144, in a scissors-type motion, owing to the swept-back geometry of the wings. Said another way, the tips of wings 136, 137 are farther from cutting edge 144 than the portion adjacent to holder 133. These means that the portions of wings 136, 137 closest to holder 133 will engage the material first, and then the cutting will work out eventually to the tips of wings 136, 137, just as a scissors starts the cut adjacent the pivot and the cutting moves to the tip.

Most preferably prior to cutter teeth 132 coming into contact with roofing, they will be sprayed with water, possibly including detergent and or other ingredients, to both lubricate and cool, and any water carried therewith will likewise help to prevent the roofing from re-agglomerating after having been crushed.

In addition, and also not illustrated, various means may be provided to remove or assist with the removal of any material that might stick to cutter 130. Such means are contemplated herein to include, though not be limited to, air knives, fixed blades, sweeps, or any other suitable member which will either redirect air flow or particle movement, and thereby prevent entrainment with the cutter teeth.

Figure 5:
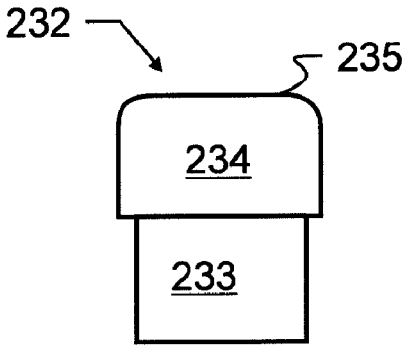
FIGS. 5 and 6 illustrate from front and side plan views a first alternative embodiment grinding tooth which may be used alternatively with the grinding teeth illustrated in FIG. 4.
Figure 6:
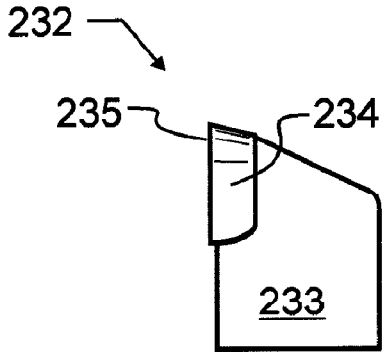

FIGS. 5 and 6 illustrate an alternative embodiment cutter tooth 232 showing a different geometry than that of cutter teeth 132. The use of a generally rectangular carbide 234 having a holder 233 permits fixed blade 140 to be altered such that openings 142 may correspond to the rectangular shape of carbide 234. This in turn allows the carbide 234 to engage the material with a flat surface or edge at the tip 235 thereof, rather than at a point formed by tip 135. Depending upon the material being comminuted, this may be an advantage, as will be determined readily by those skilled in the art when designing for a particular material.

The size of cutter tooth 132 or cutter tooth 232 is important in determining the final size of the comminuted material. Owing to the variety of material found in a commercial roof, and the likelihood for significant asphalt or similar sticky material, it is desirable to not comminute to a powder. Trying to do so will quite likely result in detrimental gumming of the equipment and re-agglomeration of particles. Instead, cutter teeth 132, 232 are designed to cut small chunks that are close to the tooth size. In the preferred embodiment, carbide 234 is in the one-half to one inch on a side range as a typical dimension, though the exact dimension will vary depending upon the material, density, asphalt content, air velocity, and many other factors. The limit on how small to comminute the material is determined by staying large enough to control the amount of gumming to provide for reasonable machine operation, while the limit on how large to comminute the material is determined by the size that may reasonably be carried within the air stream. The preferred embodiment will most preferably comminute the material without consequential gumming, and yet will also transport comminuted material within the air stream passing through outlet 182.

FIG. 7 illustrates in much greater detail the preferred air lock 190. Air lock 190 is designed to function in a manner very similar to retail and commercial revolving doors, and any confusion about the present operation should be resolved by a review of these doorway structures. Air lock 190 has a rotary paddle 194 which revolves about central shaft 200 in the direction shown by arrow 191. Ideally, shaft 200 will be similar in longitudinal measurement to the dimension of cutter 130 parallel thereto. Consequently, air lock 190 will catch all material coming from cutter 130. In the position shown in FIG. 7, material will be dropped from cutter 130 into the spaces between paddle arms 201 and 202, 202 and 203, and 203, 204. These three segments, each comprising an approximately sixty degree arc, are being filled with comminuted material. The segment between paddle arms 204 and 205 is transporting comminuted material towards an outlet, while the material between paddle arms 205, 206 is already being discharged into collector 192. Finally, the segment between paddle arms 201, 206 has already been discharged, and the material therefrom is most preferably already being carried through outlet 182.

Each paddle arm is most preferably tipped with a plastic or elastomeric scraper, thereby defining scrapers 211-216. Most preferably, these scrapers 211-216 are sufficiently rigid to form a reasonable air seal or at least impediment to air flow, and simultaneously provide minimum resistance when sliding in contact with air lock curved walls 196, 198. By providing six paddle arms 201, 206 and extending curved walls 196, 198 through an adequate arc, one or more scrapers 211-216 will at all times be in contact with curved wall 196, and likewise one or more scrapers 211-216 will also at all times be in contact with curved wall 198. Consequently, material is readily transported through air lock 190 without permitting pressurized air within outlet 182 from escaping towards cutter 130. A hose or pipe coupled to outlet 182 will then serve as a conduit through which high velocity air from blower 180 will travel and entrain chunks and particulates that have been generated as a result of the comminuting. This hose, if flexible, will be readily moved about to any work place, thereby alleviating the need for the material to be hauled about.

In order to move either roof grinder 101 or 102 about, either wheels or tracks must be provided beneath base 105, which both support the grinder and permit reasonable movement of the same over surfaces such as roofs and other work areas. Provisions may be made for propulsion of either roof grinder using motive power from engine 110, allowing for it to move across the roof as the removal of roofing rubber also progresses across the roof. The movement reduces the distance that the heavy roofing material needs to be transported. Any suitable combinations of power coupling, such as hydraulic fluids, gears, chains, belts, and so forth may be used for the propulsion.

Most preferably, the preferred embodiment roof grinders 101, 102 are constructed to be lifted on top of a commercial roof to grind rubber, asphalt, insulation, felt, and similar roofing materials. In the preferred embodiment, a user will place or stack roofing material that has been removed from the roof and cut down to appropriate size onto material conveyor 160. Conveyor 160 then carries the roofing material through to cutter 130, where the rubber and other roofing material is reduced to particles. The particles are then allowed to fall into air lock 190, and they are transferred into an air force created by blower 180. The chunks and particles are then carried through a hose or the like that terminates at a commercial roll-off waste container or the like.

From these figures, several additional features and options become more apparent. First of all, the preferred embodiment roof grinders 101, 102 are not limited by any specific blower 180, cutter 130 or grinding method, or material conveyor 160. For exemplary purposes only, and not limiting thereto, cutter 130 could comprise a series of grinding stations, each with a fixed cutting plate through which the teeth of the cutting apparatus cut the rubber, a plurality of stages of rotating rollers with rake teeth, a shredding assembly, circular saws, accelerating the roofing through a plurality of high-speed cutters, or any other suitable method. In addition, water, possibly including detergent and or other ingredients to both lubricate and cool, will preferably be sprayed upon the cutter roller. The mixture will serve to both cool and lubricate the rollers, reduce dust, assist with preventing the gumming of the cutter wheel and also reduce sticking of roofing materials, thus preventing clumping and permitting the blowing of the particles.

Figure 8:
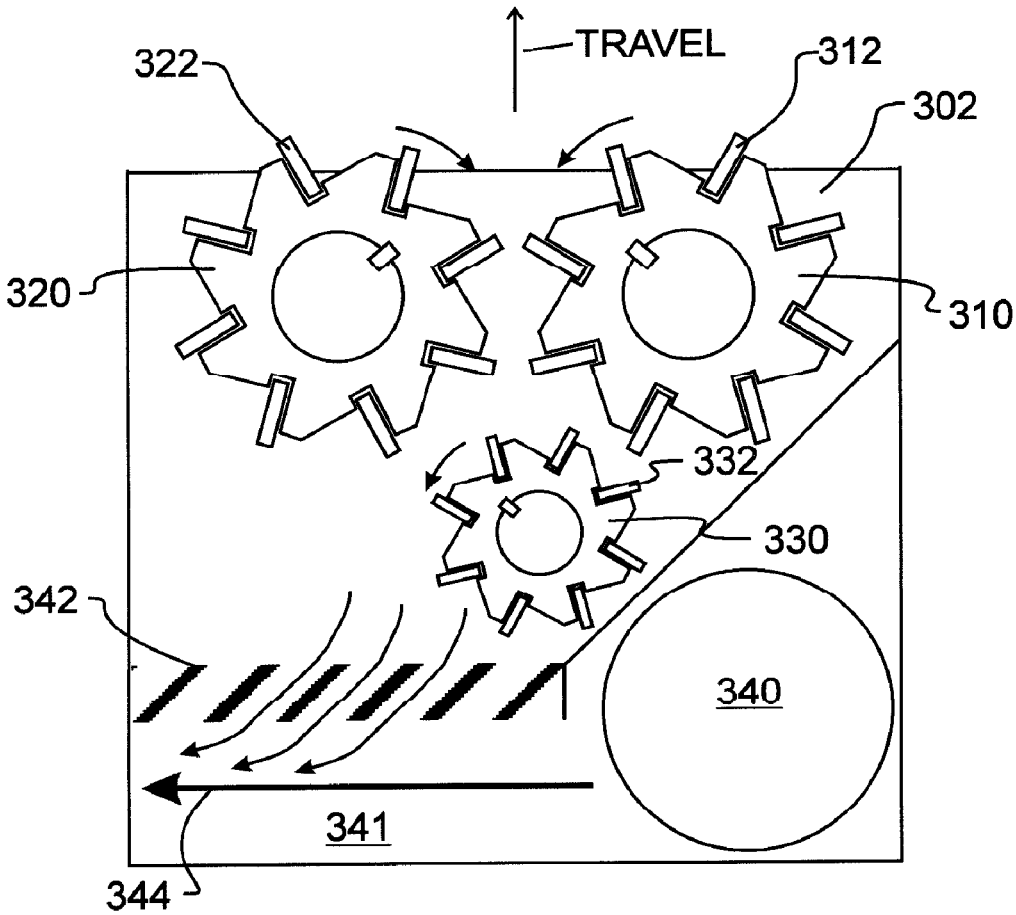
FIG. 8 illustrates a third alternative embodiment roof grinder from top, schematic view.

FIG. 8 illustrates a second alternative embodiment roofing cutter 300. In this embodiment, a base 302 is provided which will preferably run against a sub-roof, which is typically a steel or wooden supporting structure upon which rubber and asphalt roofing materials are applied to seal the roof against moisture penetration. To initially place base 302 against the sub-roof, a small square or section of the roofing must be cut and removed, to clear enough space adjacent the sub-roof for roofing cutter 300. Once base 302 is resting firmly against the sub-roof, power may be applied to cause cutters 310, 320 and 330 to rotate, and to cause blower 340 to blow air through conduit 341 towards outlet 344. The rotation of cutter teeth 312, 322 will cause these teeth to engage with roofing material as roofing cutter 300 is advanced in the direction of travel. As the material is cut by cutters 310, 320, it will be forced therebetween, and will be ejected adjacent to cutter 330. Any larger sections of roofing material that might pass between cutter teeth 312, 322 will in turn be cut by cutter 330, ensuring small particle sizes. Further, the combined rotation of each of the cutters 310, 320, 330 will accelerate the particles towards grating 342, ultimately to be drawn into conduit 341. While not shown, roofing cutter 300 will most preferably ride across the sub-roof on base 302, and so the roofing material may be simultaneously removed and comminuted directly therefrom. A handle may be provided, and any suitable sources of power to drive the cutters and blower will be provided. This second alternative embodiment cutter will therefore alleviate the need to lift and carry the roofing materials about.

While the foregoing details what is felt to be the preferred and additional alternative embodiments of the invention, no material limitations to the scope of the claimed invention are intended. The variants that would be possible from a reading of the present disclosure are too many in number for individual listings herein, though they are understood to be included in the present invention. For exemplary purposes only, and not limited thereto, those skilled in the art of grinding and comminution will recognize that the present machine will have application to those fields as well. More particularly, during the remodeling and reconstruction of a building, it is common to dispose of various building materials such as metal studs, plaster and other wall materials, carpet and other flooring, and so forth. The present machines facilitate the removal of such materials, through both comminution and transport to a waste container. Consequently, features and design alternatives that would be obvious to one of ordinary skill in the arts to which the invention may pertain are considered to be incorporated herein. The scope of the invention is set forth and particularly described in the claims herein below.

I claim:

1. A roof grinder operative to both comminute and transport rubber, asphalt, insulation and rock material during building renovation which saves manual labor and provides for compact waste disposal, comprising, in combination:

a cutter which comminutes commercial roofing material and has a rotating drum carrying a plurality of teeth protruding therefrom; and further has a fixed blade having a non-linear cutting edge with a first cutting surface between at least two of said plurality of teeth and a second cutting surface more distal from said rotating drum than said at least two of said plurality of teeth;

an air transport having a high velocity air stream receiving said comminuted roofing material and transporting said comminuted roofing material within said high velocity air stream; and a rotary air lock coupled to said cutter for receiving said comminuted roofing material and coupled to said air transport to deliver said received comminuted roofing material thereto while preventing said high velocity air stream from passing through said cutter.

2. The roof grinder operative to both comminute and transport rubber, asphalt, insulation and rock material of claim 1, wherein said rotary air lock further comprises:

a rotating shaft defining an axis of rotation;

a plurality of paddles rigidly coupled to said rotating shaft, each ones of said plurality of paddles angularly offset from adjacent ones of said plurality of paddles about said axis of rotation and thereby forming comminuted material receivers between adjacent ones of said plurality of paddles, said plurality of paddles carried in rotary motion with said rotating shaft; and a pair of opposed housing walls, said paddles and walls forming an impediment to airflow, and thereby preventing said high velocity air stream from passing through said rotary air lock to said cutter while simultaneously transporting said comminuted material from said cutters to said high velocity air stream.

3. The roof grinder operative to both comminute and transport rubber, asphalt, insulation and rock material of claim 2, wherein said paddles are further tipped with elastomeric scrapers that couple with said pair of opposed housing walls to provide an impediment to air flow therebetween.

4. The roof grinder operative to both comminute and transport rubber, asphalt, insulation and rock material of claim 1, further comprising:

a mobile frame supporting said cutter and air transport.

5. The roof grinder operative to both comminute and transport rubber, asphalt, insulation and rock material of claim 1, wherein said cutter comminutes said material to a size large enough to restrict an amount of gumming to permit reasonable machine operation, while said cutter comminutes said material to a size small enough to reasonably be carried within said air stream.

6. The roof grinder operative to both comminute and transport rubber, asphalt, insulation and rock material of claim 1, wherein said commercial roofing material further comprises rubber, asphalt, insulation and rock.

7. The roof grinder operative to both comminute and transport rubber, asphalt, insulation and rock material of claim 1, wherein said cutter is operative upon a roof sub-floor to both remove and comminute said commercial roofing material.

8. The roof grinder operative to both comminute and transport rubber, asphalt, insulation and rock material of claim 1, wherein said plurality of teeth further comprise a plurality of cutter teeth, one of said cutter teeth having a pair of swept-back wings immediately adjacent to said one of said cutter teeth that passes adjacent to said second blade after said one of said cutter teeth.

9. The roof grinder operative to both comminute and transport rubber, asphalt, insulation and rock material of claim 8, wherein said plurality of cutter teeth are longitudinally offset from radially extensive from said first rotating drum.

10. The roof grinder operative to both comminute and transport rubber, asphalt, insulation and rock material of claim 1, further comprising a sprayer that sprays said plurality of teeth, to thereby cool said cutter, assist with dust control, dislodge residue from said cutter, and forma slight barrier to adhesion of said roofing to said cutter.

11. The roof grinder operative to both comminute and transport rubber, asphalt, insulation and rock material of claim 1, further comprising a material shield adjacent to said rotating drum and distal from said second fixed blade to limit material already once comminuted from being carried by said plurality of teeth into contact with said fixed blade a second time.

* * * * *